United States Patent [19]

Jackson

[11] 4,176,211

[45] Nov. 27, 1979

[54] C-SHAPED POLYESTER FILAMENTS

[75] Inventor: Henry G. Jackson, Greenville, S.C.

[73] Assignee: Phillips Petroleum Company, Bartlesville, Okla.

[21] Appl. No.: 902,199

[22] Filed: May 2, 1978

[51] Int. Cl.[2] ..... B28B 21/54

[52] U.S. Cl. ..... 428/397; 156/500; 264/177 F

[58] Field of Search ..... 264/177 F; 428/397; 156/500; 425/382

[56] References Cited

U.S. PATENT DOCUMENTS

| | | | |
|---|---|---|---|
| 2,403,473 | 7/1946 | Kohorn | 264/177 F |
| 2,666,976 | 1/1954 | Olmer et al. | 264/177 F |
| 2,804,645 | 9/1957 | Wilfong | 264/177 F |
| 2,831,748 | 4/1958 | Foulayson et al. | 264/177 F |
| 3,063,094 | 11/1962 | Warthen | 264/177 F |
| 3,109,195 | 11/1963 | Combs et al. | 264/177 F |
| 3,340,571 | 9/1967 | Bishop et al. | 264/177 F |
| 3,981,948 | 9/1976 | Phillips | 264/177 F |

FOREIGN PATENT DOCUMENTS

| | | | |
|---|---|---|---|
| 43-16666 | 7/1968 | Japan | 264/177 F |
| 48-43566 | 12/1973 | Japan | 264/177 F |
| 49-33696 | 9/1974 | Japan | 264/177 F |

*Primary Examiner*—Jay H. Woo

[57] ABSTRACT

A method for producing polyester filament having a cross-section of C-shape by melt spinning polyester through a spinneret so that each filament is made through an array of holes having a center hole with eight holes equally spaced around the center hole with the size and spacing of the holes within a specified relationship. A method for producing partially oriented yarn having a cross-section of C-shape. A polyester filament produced, a yarn composed of a multiplicity of these filaments, and a fabric produced from the yarn.

11 Claims, 3 Drawing Figures

C-SHAPED POLYESTER FILAMENTS

BACKGROUND OF THE INVENTION

Figure 2:
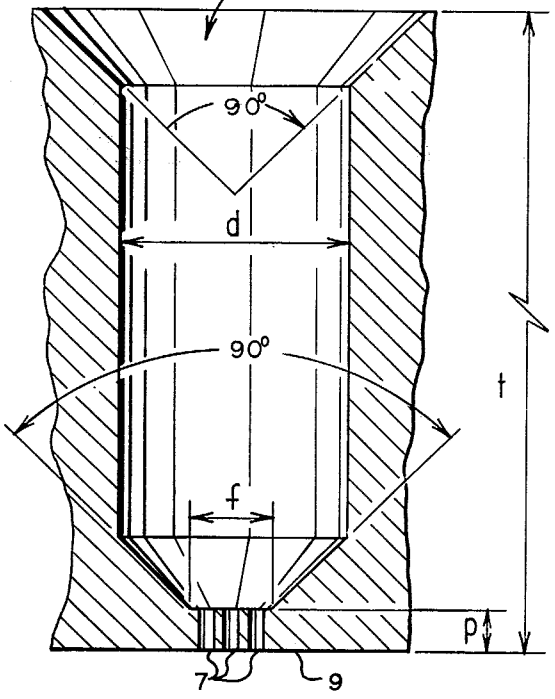

This invention relates to polyester filaments. In one of its aspects this invention relates to melt spinning of polyester filaments. In another of its aspects this invention relates to yarn produced from a multiplicity of filaments and fabric produced from this yarn.

In preferred aspects of the invention, it relates to the manufacture of polyester yarn which can be made into a double knit fabric which does not exhibit sparkle highlights when exposed to sunlight or other intense light.

In the recent past, polyester yarns have become widely used in apparel fabrics for women's wear such as pantsuits, blouses, skirts, dresses, coats and other items of apparel. Polyester yarn fabrics have also been adapted for use in men's wear for double knit suits, trousers, and the like. These polyester fabrics have demonstrated wash and wear characteristics which make them most desirable. The fabrics are also quite durable as compared to some of the natural fibers.

There has, however, been a major objection to fabrics made from polyester yarns when used in men's wear. This objection is based on the fact that polyester yarns generally produce sparkle highlights when exposed to sunlight or other intense light. A more desirable fabric for men's wear would not exhibit the sparkle or sparkle highlights but could exhibit a sheen which does not glitter.

Synthetic fibers can be made in a wide variety of individual filament cross-sections such as round, flat, trilobal, Y-shaped, octalobal, and the like. Most of the yarns which exhibit sparkle highlights are made from filaments that are round or substantially round. The reflection of light from these filaments causes the sparkle highlights. One method used for reducing the sparkle highlights is to use an octalobal fiber, i.e., a fiber having eight lobes, in the production of yarns. The octalobal fibers are usually made with a spinneret in which each hole has a cross-section having eight wings emanating from a center point. These eight wings may have different configurations at the ends of the wings such as a round lobe, but still upon extrusion the polymer swells to cause the wing extrudate to come together to form an octalobal fiber. Normally a spinneret will have 34 of these winged holes, but can have any number desired.

The spinneret described above for producing an octalobal fiber is expensive to construct and has operational shortcomings. During the spinning of fibers it often becomes necessary to wipe the spinneret to remove charred polymer. This is usually done with an implement called a wipe stick that is made from bronze and is substantially in the shape of a chisel. With the type of hole configuration in which the wings extend radially from the center, the wings are usually about 0.003" wide. Carbon particles frequently become lodged in the wings so that the fiber extruding from the hole in the spinneret is distorted. Carbon particles also frequently substantially plug the opening.

To overcome the disadvantages discussed above, it was determined to make and octalobal fiber by using an array of nine round holes arranged so that there was one center hole with eight equally spaced holes around the center hole for each of 34 fibers extruded from the spinneret. Upon extrusion it would be expected that the polymer from each of the nine holes would coalesce to form an individual filament. The use of such an arrangement to make a filament is not new in the art. Surprisingly, however, upon using such an array of nine holes within certain limitations of size, the fiber produced was not octalobal but was C-shaped. Furthermore, it was observed that the C-shaped fibers exhibit some flat spots. Happily, upon subsequent draw texturing of yarn made from the C-shaped fibers it was discovered that fabric made from these yarns exhibited the non-glitter or sheen when viewed in the sunlight that makes octalobal filaments particularly valuable. The spinneret used in producing the C-shaped fibers is economical to manufacture and does not have the plugging and contamination drawbacks of the eight winged type configuration.

It is therefore an object of this invention to provide a method for producing C-shaped fibers of polyester. It is also an object of this invention to provide C-shaped fibers of polyester produced by this method, to combine these fibers into yarns, and to produce fabric from the yarn which exhibits non-glitter characteristics. It is also an object of this invention to provide a method for producing fibers using an economical spinneret. It is another object of this invention to provide a method for producing fibers using a spinneret that has a minimum of plugging and contamination problems.

Other aspects, objects, and the various advantages of this invention will become apparent upon studying this specification, the drawing, and the appended claims.

STATEMENT OF THE INVENTION

In accordance with this invention, a method is provided for producing a polyester filament having a cross-section of C-shape. In the method, the polyester is melt spun through a spinneret so that each filament is made through an array of holes having a center hole with eight holes equally spaced around this center hole at a distance from the center hole which causes coalescence of the extrudate into a C-shaped filament. In the arrangement useful in this invention the radius of the center of each of the outside holes from the center of the central hole can be in the range of up to about 3 times the diameter of a hole, with the diameter of a hole within the range of about 0.15 mm to about 0.75 mm, the diameter usually used for spinneret holes. For spinning fibers for clothing the preferred range of diameter for spinneret holes is about 0.20 mm to about 0.35 mm. Preferably the distance of the center of the outside holes from the center of the central hole is in a range of up to about 2 times the diameter of the hole. A spinneret can have any desired number of the above arrays of holes as long as the arrangement is sufficiently spaced to allow production of individual filaments upon coalescing of the polymer emanating from each cluster of holes.

Figure 1:
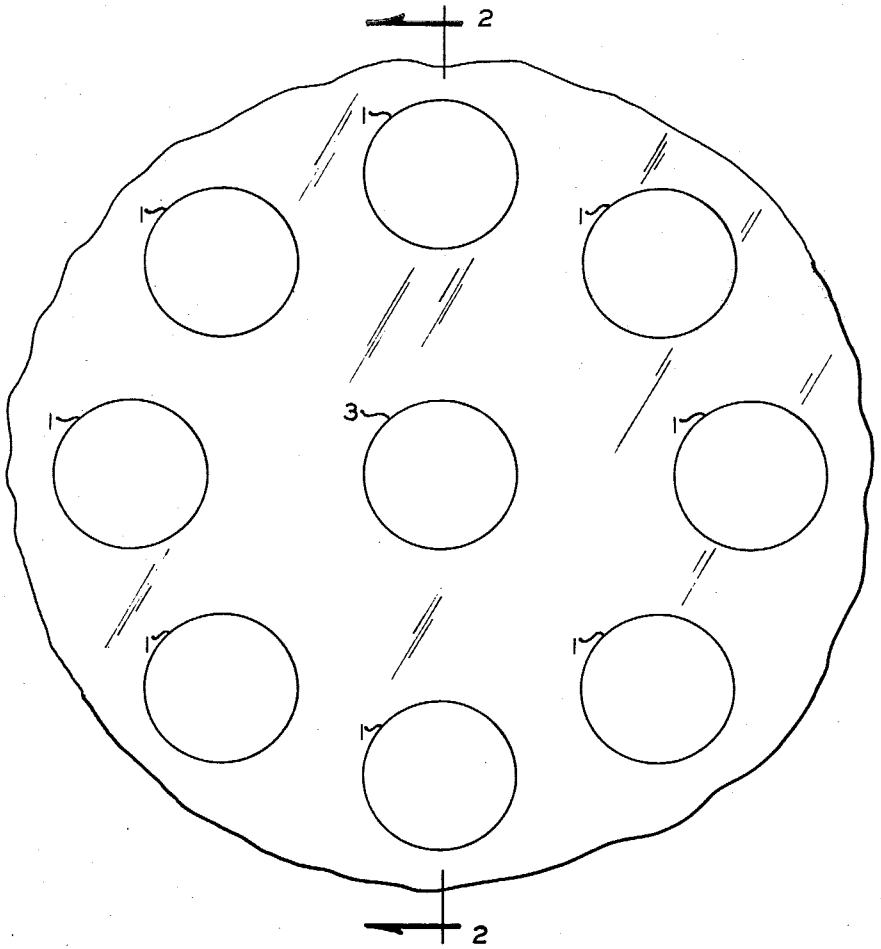
Figure 3:
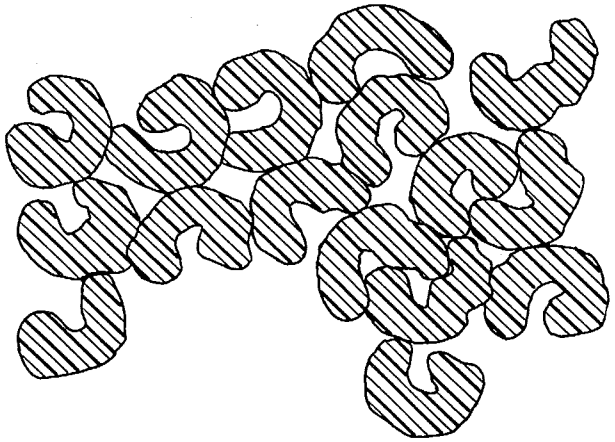

A better understanding of the invention can be obtained in conjunction with the drawing in which FIG. 1 is a view of a preferred arrangement of an array of the holes on a spinneret face for forming one filament, FIG. 2 is a side view through 2/2 of FIG. 1 of a portion of a spinneret showing the counterbore above a single filament producing array in a preferred embodiment of the spinneret in this invention, and FIG. 3 shows a cross-section of fibers produced using the spinneret of the present invention.

Referring now to FIG. 1 the alignment of the holes in an array on the face of the spinneret is shown which is described below as used in the example. The figure shows eight circular holes 1 of substantially equal diameter arrayed in even alignment around the ninth central hole 3 with the center of the surrounding holes removed two diameters from the center of the central hole. Although the holes could be of a shape other than circular in the most preferred embodiment circular holes having a diameter of 0.20 mm are used.

In FIG. 2 is seen a cross-section of a spinneret plate showing the bore 5 into which molten polymer is passed to be pressured through an array of spinneret holes 7 at the face 9 of the spinneret plate. The conditions for producing molten polyester and the conditions required for expressing this material through a spinneret are well known in the art.

As shown in FIG. 2, for each array of spinneret holes a bore is passed almost through the thickness t of the spinneret plate with counterbore at the top and the bottom of the bore to provide a flat surface of a desired thickness p at the bottom of the bore through which the spinneret array is drilled. In a most preferred embodiment of the invention a bore of diameter $d = 3$ mm is drilled through a plate of thickness $t = 50$ mm so that with a 90 degree chamfer at the bottom of the bore a circular, flat surface having a face diameter $f = 1.25$ mm is provided at a plate thickness $p = 0.8$ mm from the outside face of the plate. The top of the bore is countersunk with a 90 degree chamber.

Upon passing through the spinneret hole array, the polyester from the nine individual holes coalesces into a single filament that has a cross-section that can be best described as roughly C-shaped. As can be seen in FIG. 3 the surface of the filaments does not form as a continuously smooth line but rather is irregular in outline.

When yarns of the type used for double knit fabrics are melt spun they are conventionally made as a partially oriented yarn (POY). The yarn leaves the spinneret in a vertical direction and travels for a sufficient distance to be quenched by cross-current air and then taken up at speeds from about 1800 to about 3200 meters per minute. The yarn is taken up on a spool in a large package which may weigh as much as 11 to 12 pounds. At this point, the yarn does not have bulk and is termed a flat yarn, which means a yarn that has not been textured. In a second step, the yarn is either sequentially drawn and textured by false twist texturing or can be simultaneously draw textured. After texturing, the yarn exhibits bulk and can be used to make double knit fabrics.

A polyester filament having a cross-section of C-shape is produced by the method of this invention. These filaments can be conventionally combined into a yarn composed of a multiplicity of filaments. The filaments can be treated as described above partially to orient the yarn and to texture the yarn and then conventionally made into a fabric as by knitting or wearing the yarn. The invention is illustrated by the following example.

EXAMPLE

Polyester was melt spun through a spinneret comprising arrays of nine round holes—one center hole and eight equally spaced holes of diameter of 0.20 mm with the radius of the center of each of the outside holes from the center of the central hole a distance of 0.40 mm. The spinneret consisting of 34 such clusters was therefore capable of making 34 fibers of the coalesced polymer. The filaments were contacted with cross-current quench air at 78° F. (25.5° C.) at a velocity of 80–100 cfm when 3.812 inches (9.68 cm) from the spinneret face. In operation, each cluster produced a fiber that coalesced into a C-chaped filament while being quenched by traveling through air and wound on winder at 1800 meters per minute. The yarn produced at a total denier of 415. This partially oriented yarn was draw textured to produce a yarn 150/34—150 denier with 34 filaments—which was suitable for knitting. The yarn was conventionally knitted to produce a fabric which exhibited good non-glitter characteristics.

I claim:

1. A method for producing a polyester filament having a cross-section of C-shape, comprising extruding molten polyester through a spinneret having at least one array of circular holes in a pattern comprising a center hole with eight holes equally spaced around said center hole wherein each hole has an equal diameter of about 0.15 to about 0.75 mm and the radius at the center of each of the outside holes from the center of the central hole is up to about three times the diameter of the holes.

2. A method of claim 1 wherein each hole has a diameter of about 0.20 mm and the radius of the center of each of the outside holes from the center of the central hole is about 0.40 mm.

3. A method of claim 1 wherein said filament is discharged from the spinneret and air quenched at takeup conditions above 1800 meter/min.

4. A polyester filament having a cross-section of C-shape produced by the method of claim 1.

5. A polyester filament having a cross-section of C-shape produced by the method of claim 2.

6. A yarn comprised of a multiplicity of filaments of claim 4.

7. A yarn comprised of a multiplicity of filaments of claim 5.

8. A fabric knitted from the yarn of claim 6.

9. A fabric knitted of the yarn of claim 7.

10. A fabric woven of the yarn of claim 6.

11. A fabric woven of the yarn of claim 7.

* * * * *